US007413591B2

(12) United States Patent
Tokunaga

(10) Patent No.: US 7,413,591 B2
(45) Date of Patent: Aug. 19, 2008

(54) THROW-AWAY TIP AND CUTTING TOOL

(75) Inventor: Takashi Tokunaga, Sendai (JP)

(73) Assignee: Kyocera Corporation, Kyoto (JP)

( * ) Notice: Subject to any disclaimer, the term of this patent is extended or adjusted under 35 U.S.C. 154(b) by 379 days.

(21) Appl. No.: 10/744,634

(22) Filed: Dec. 23, 2003

(65) Prior Publication Data

US 2004/0137219 A1 Jul. 15, 2004

(30) Foreign Application Priority Data

Dec. 24, 2002 (JP) ..... 2002-372074
Jan. 14, 2003 (JP) ..... 2003-005225
Jan. 24, 2003 (JP) ..... 2003-015987
Nov. 27, 2003 (JP) ..... 2003-397312

(51) Int. Cl.
*C22C 29/04* (2006.01)

(52) U.S. Cl. ..... 75/244; 407/119; 75/238; 75/240; 75/237

(58) Field of Classification Search ..... 75/238, 75/240, 244, 237; 419/15; 407/119
See application file for complete search history.

(56) References Cited

U.S. PATENT DOCUMENTS 4,948,425 A * 8/1990 Watanabe et al. ..... 75/238
5,137,565 A * 8/1992 Thelin et al. ..... 75/238
5,149,361 A * 9/1992 Iyori et al. ..... 75/244
5,186,739 A * 2/1993 Isobe et al. ..... 75/238
5,306,326 A * 4/1994 Oskarsson et al. ..... 75/238
5,370,719 A * 12/1994 Teruuchi et al. ..... 75/237
5,421,851 A * 6/1995 Oskarsson et al. ..... 75/238
5,462,574 A * 10/1995 During et al. ..... 75/238
5,470,372 A * 11/1995 Weinl ..... 75/238
5,476,530 A * 12/1995 Gries et al. ..... 75/238
5,503,653 A * 4/1996 Oskarsson et al. ..... 75/238
5,670,726 A * 9/1997 Kolaska et al. ..... 419/15
5,694,639 A * 12/1997 Oskarsson et al. ..... 419/16
5,710,383 A * 1/1998 Takaoka ..... 75/238
5,766,742 A * 6/1998 Nakamura et al. ..... 428/469
5,976,213 A * 11/1999 Rolander et al. ..... 75/238
6,004,371 A * 12/1999 Rolander et al. ..... 75/238
6,010,283 A * 1/2000 Henrich et al. ..... 407/119
6,124,040 A 9/2000 Kolaska et al.
6,193,777 B1 * 2/2001 Weinl et al. ..... 407/119

(Continued)

FOREIGN PATENT DOCUMENTS

DE 43 40 652 6/1995

(Continued)

*Primary Examiner*—Archene Turner
(74) *Attorney, Agent, or Firm*—Hogan & Hartson LLP

(57) ABSTRACT

The throw-away tip has a shape of substantially flat plate, comprising from 1 to 30% by weight of binder phase comprising at least one kind of Co and Ni, and 70 to 99% by weight of carbonitride phase comprising composite metal carbonitride of Ti and one or more kind other than Ti among metals of groups 4*a*, 5*a* and 6*a* of the Periodic Table, wherein the mean grain size of the carbonitride phase is 1.5 μm or less, while flexural strength test pieces which are cut out of ten throw-away tips including the side face thereof show flexural strength with a Weibull coefficient of 5 or higher. Throw-away tips having fine carbonitride phase structure and high cutting performance can be made with less variance among individual throw-away tips.

9 Claims, 1 Drawing Sheet

2 μm

U.S. PATENT DOCUMENTS 6,231,277 B1 * 5/2001 Abukawa ..... 407/119

FOREIGN PATENT DOCUMENTS

| | | |
|---|---|---|
| DE | 698 09 916 | 7/2003 |
| JP | 58-213842 | 12/1983 |
| JP | 04-289003 | 10/1992 |
| JP | 05-192804 | 8/1993 |
| JP | 05-222551 | 8/1993 |
| JP | 06-017229 | 1/1994 |
| JP | 08-057703 | 3/1996 |
| JP | 09-239605 | 9/1997 |
| JP | 2001-277008 | 10/2001 |
| JP | 2001-329331 | 11/2001 |
| WO | 98/51830 | 11/1998 |

* cited by examiner

THROW-AWAY TIP AND CUTTING TOOL

BACKGROUND OF THE INVENTION

1. Field of the Invention

The present invention relates to a throw-away tip made of cermet and a cutting tool having high cutting performance and, more particularly, to a throw-away tip made of cermet and a cutting tool having a fine micro structure with less variations in characteristics among individual pieces.

2. Description of Related Art

Such cermet constituted from a carbonitride phase comprising a composite metal carbonitride of Ti and at least one kind of metals of groups 4a, 5a and 6a of the Periodic Table other than Ti, and a binder phase of Co and/or Ni, and throw-away tips made of such cermet of which surface is coated with the carbonitride phase coating layer such as TiC, TiN or TiCN formed by chemical deposition or physical deposition process have been used for continuous cutting or intermittent cutting of workpiece made of steel or the like (see, for example, Japanese Unexamined Patent Publication No. 5-222551 and Japanese Unexamined Patent Publication No. 4-289003).

It has been in practice to control the grain size of the carbonitride phase of cermet in order to increase the hardness and strength of the cermet thereby to improve the wear resistance and chipping resistance of the throw-away tip. For example, it is described to control the mean grain size to 2 μm or less inside the cermet in Japanese Unexamined Patent Publication No. 5-192804 and Japanese Unexamined Patent Publication No. 6-17229.

However, although it is indispensable to prepare a fine powder as the stock material in order to control the carbonitride phase so as to consist of fine grains as described in Japanese Unexamined Patent Publication No. 5-192804 and Japanese Unexamined Patent Publication No. 6-17229, it leads to such a problem as the material powder such as carbides, nitrides and carbonitrides that constitute the carbonitride phase agglomerate, and requires it to raise the firing temperature since the material becomes difficult to sinter. As a result, melding and/or decomposition of the binding phase are accelerated, thus leading to inhomogeneous structure due to segregation of the binding phase, generation of voids on the surface and/or inside of the sintered material, resulting in considerable variations in the mechanical characteristics and cutting performance among throw-away tips thus manufactured.

Therefore, it has been necessary to set the parameters for using a replacement tool insert to the parameters of using a throw-away tip of low cutting performance when the throw-away tip that has been used in machining a predetermined number of workpieces is automatically changed regardless of the wear condition and, even when a throw-away tip having high performance is formed, the high performance cannot be utilized and the tool cost is increased.

Throw-away tips used in metal cutting operations are made mainly of cemented carbide consisting of a carbonitride phase made of tungsten carbide that is held together by a binder phase of Co (for example, Japanese Unexamined Patent Publication No. 8-57703 and Japanese Unexamined Patent Publication No. 2001-329331) and TiCN-based cermet consisting of a carbonitride phase made of composite metal carbonitride of Ti and at least one kind of metals of groups 4a, 5a and 6a of the Periodic Table other than Ti that is held together by a binder phase of Co and/or Ni (for example, Japanese Unexamined Patent Publication No. 2001-277008 and Japanese Unexamined Patent Publication No. 9-239605).

Cutting tools made of cemented carbide are used in wide applications ranging from rough cutting to finishing, and throw-away tips made of TiCN-based cermet are used in finishing operations due to high wear resistance and better characteristic with regard to resistance to the reaction with steel.

In recent years, however, depletion of the resources for tungsten carbide is feared. Accordingly, demands are increasing for throw-away tips made of TiCN based cermet that show high cutting performance in wide applications, particularly in rough cutting operations.

However, the cutting tool receives greater impact during rough cutting than finishing. As a result, the throw-away tips made of TiCN-based cermet disclosed in Japanese Unexamined Patent Publication No. 2001-277008 and Japanese Unexamined Patent Publication No. 9-239605, when used in rough cutting operations, are likely to be chipped prematurely due to the impact of cutting operation, thus showing performance poorer than that of cutting tools made of cemented carbide.

Moreover, as new hard-to-cut metals such as Pb-free free cutting steel are put into use, the TiCN-based cermet of the prior art does not show sufficient cutting performance in finishing operation. Accordingly, there is a demand for cermet having better cutting performance in finishing operations to which cermet has been preferably used.

SUMMARY OF THE INVENTION

In a research to solve the problems described above, the inventor of the present application has found that reliability of the cutting performance of a throw-away tip can be improved by making the grains of a carbonitride phase finer and reducing the variance in the flexural strength of the throw-away tip.

The throw-away tip of the present invention has a shape of substantially flat plate, constituted from 1 to 30% by weight of a binder phase containing at least one of Co and Ni, and 70 to 99% by weight of a carbonitride phase made of composite metal carbonitride comprising Ti and at least one kind of metals of groups 4a, 5a and 6a of the Periodic Table other than Ti, wherein the mean grain size of the carbonitride phase is 1.5 μm or less, while flexural strength test pieces which are cut out of ten throw-away tips including the side face thereof show flexural strength with a Weibull coefficient of 5 or higher.

It is preferable that at least 50% of the fracture origins observed in the fracture surface after flexural strength test of the test pieces consist of voids of which part or entire wall surface is covered by a skin made of the binder phase. This constitution enables it to control the properties of coarse voids, that make the significant cause of variance in the characteristics of the throw-away tip (fine-micro-cermet), so as to be less likely to fracture, thereby to minimize the effect of the fracture origin existing in the sintered material and suppress the variance in the characteristics of the throw-away tip.

Also a throw-away tip for rough cutting that has cutting performance equivalent to or higher than that of cemented carbide, or a throw-away tip for finishing that has high cutting performance with high chipping resistance and high wear resistance during finishing operations can be obtained by controlling the contents of Ti and the binding phase and the grain size of the carbonitride phase.

The throw-away tip for rough cutting according to the present invention is comprised of the binder phase containing at least one kind of Co and Ni as the major component and the carbonitride phase made of carbonitride of mainly Ti and other metals of groups 4a, 5a and 6a of the Periodic Table, wherein the total content of Co and Ni is in a range from 15 to 22% by weight and 55 to 80% by weight of Ti is contained in an amount based on the total content of metals of groups 4a, 5a and 6a of the Periodic Table, while the carbonitride phase in the cermet body has mean crystal grain size in a range from 0.5 to 1 μm.

The throw-away tip for finishing according to the present invention is composed of the binder phase containing at least one kind of Co and Ni as the major component and the carbonitride phase made of carbonitride of mainly Ti and other metals of groups 4a, 5a and 6a of the Periodic Table, wherein the total content of Co and Ni is in a range from 4 to 14% by weight and 55 to 80% by weight of Ti is contained in an amount based on the total content of metals of groups 4a, 5a and 6a of the Periodic Table, while the carbonitride phase in the central portion has mean crystal grain size in a range from 0.5 to 1 μm.

DESCRIPTION OF PREFERRED EMBODIMENTS

First Embodiment

Figure 1:
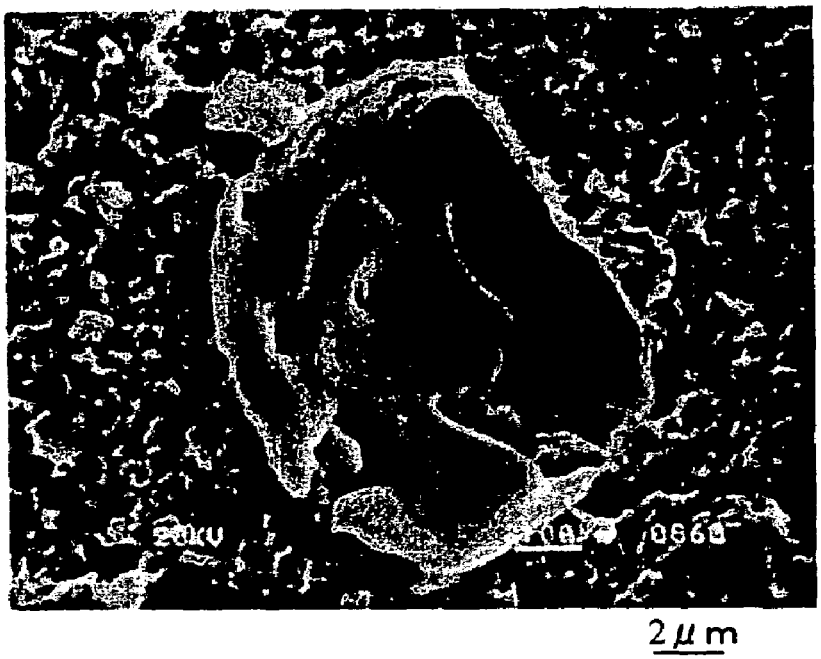
FIG. 1 shows a fracture surface near a fracture origin of test piece No. II-4 of an example after flexural strength test observed with a scanning electron microscope (SEM).

Now a method for manufacturing the throw-away tip according to the present invention will be described below.

First, the following components (1) to (3) are weighed and mixed in predetermined proportions:

(1) a TiCN powder;

(2) a carbide powder, a nitride powder and a carbonitride powder that contain at least one kind selected from among metals of groups 4a, 5a and 6a of the Periodic Table other than Ti, particularly W, Mo, Ta, V, Zr and Nb; and (3) a binder phase forming components consisting of at least one kind of Co and Ni powder.

The carbonitride phase forming components all have a mean grain size in range from 0.2 to 0.9 μm, preferably from 0.5 to 0.8 μm. By controlling the mean grain size in this range, it may be suppressed that the binder phase agglomerates so as to form a portion may become a fracture origin in the cermet structure and voids are generated due to elution of the agglomerated binder phase, leading to greater variance in the flexural strength, and flexural strength of the cermet as a whole may be increased. When the mean grain size is smaller than 0.2 μm, the binder phase agglomerates so as to form a portion that may become a fracture origin in the cermet structure and voids are generated due to elution of the agglomerated binder phase, leading to greater variance in the flexural strength. When the mean grain size is larger that 0.9 μm, flexural strength of the cermet as a whole may decrease.

The binder phase forming components have a mean grain size in the range from 0.05 to 1 μm, preferably from 0.3 to 0.6 μm. By controlling the mean grain size in this range, it may be suppressed that the binder phase agglomerates so as to form a portion that generates a fracture origin and voids is generated due to elution of the agglomerated binder phase and/or metals in the agglomerated portion that may become the fracture origin, and the binder phase may be distributed evenly. When the mean grain size is smaller than 0.05 μm, the binder phase is likely to agglomerate so as to form a portion that generates a fracture origin and voids are likely to be generated due to elution of the agglomerated binder phase and/or metals in the agglomerated portion that may become the fracture origin. When the mean grain size is larger than 1 μm, the binder phase is likely to be distributed unevenly.

Among the carbonitride phase forming components, at least the TiCN powder is controlled to include oxygen content of 1% by weight or less, preferably in a range from 0.05 to 0.8% by weight. By controlling oxygen content in this range, it be suppressed that voids are generated in the sintered material and/or the binder phase agglomerates, leading to variance in the flexural strength of the sintered material and resulting in greater variations in the cutting performance of the throw-away tip. When the oxygen content in the TiCN powder is more than 1% by weight, there is higher possibility that voids are generated in the sintered material and/or the binder phase agglomerates, leading to variance in the flexural strength of the sintered material and resulting in greater variations in the cutting performance of the throw-away tip.

The carbonitride phase forming components and the binder phase forming components are mixed in such proportions as content of the carbonitride phase forming components is from 70 to 99% by weight, particularly from 80 to 90% by weight, and the content of the binder phase forming components is from 1 to 30% by weight, particularly from 10 to 20% by weight. By controlling in this range, it may become possible to form a fine micro structure of alloy, and the cermet may have sufficient hardness leading to low wear resistance of the throw-away tip. When the content of the carbonitride phase forming components is less than the range described above or content of the binder phase forming components is more than the range described above, it may become impossible to form a fine micro structure of alloy while maintaining fine grains of the carbonitride phase. When the content of the carbonitride phase forming components is more than the range described above or the content of the binder phase forming components is less than the range described above, the cermet may have insufficient hardness leading to low wear resistance of the throw-away tip.

Then the powders are mixed and crushed with an attritor mill, so as to obtain a mixed powder having such a particle size distribution as measured by micro track method, that the proportion of particles not smaller than 1 μm is 10% by weight or less. This enables it to prevent coarse grains from being contained in the sintered cermet, prevent the surface of the sintered material from being roughened by the generation of coarse grains, and suppress variations in the structure, thereby forming cermet of homogeneous structure. In order to control the proportion of particles not smaller than 1 μm within 10% by weight, the crushing operation may be stopped when the particle size distribution described above has been achieved, or the powder may be subjected to classification as required.

The mixed powder is molded into the shape of throw-away tip, and is sintered by the following steps:

(a) increasing the temperature from the room temperature to a firing temperature A in a range from 1100 to 1250° C.;

(b) increasing the temperature from the firing temperature A to 1300° C. at a raising rate a in a range from 0.5 to 3° C./min;

(c) increasing the temperature from 1300° C. to a firing temperature B in a range from 1400 to 1500° C. at a raising rate b in a range from 5 to 15° C./min;

(d) increasing the temperature to a firing temperature C in a range from 1500 to 1600° C. at a rate c in range from 4 to 14° C./min, that is lower than the raising rate b; and (c) decreasing the temperature.

When the temperature raising rate A in the step (b) is lower than 0.5° C./min, grains grow in the carbonitride phase. When the temperature raising rate A is higher than 3° C./min, the binder phase forming components partially fuse to form agglomerated portion of the binder phase.

When the temperature raising rate B in the step (c) is lower than 5° C./min, grains grow in the entire sintered material making it impossible to control the mean grain size of the carbonitride phase within 1.5 μm, resulting in lower chipping resistance. When the temperature raising rate B is faster than 15° C./min, grain growth in the sintered material became uneven and Weibull coefficient of the throw-away tip becomes lower than 5 due to local coagulation of the binder phase and abnormal grain growth. When the firing temperature B is lower than 1400° C., liquid phase cannot be sufficiently developed in the preliminary sintering in the step (b). When the firing temperature B is higher than 1500° C., liquid phase develops excessively leading to the generation of much voids on the surface of the cermet substrate. In either case, the Weibull coefficient of the throw-away tip becomes lower than 5.

When the temperature raising rate C in the step (d) is lower than 4° C./min, grains of the carbonitride phase grow to 1.5 μm or larger on the surface of the substrate, resulting in lower chipping resistance. When the temperature raising rate c is higher than 14° C./min, structure of the sintered material becomes inhomogeneous resulting in lower wear resistance. In addition, when the firing temperature C is lower than 1500° C., the substrate cannot be made sufficiently dense, with voids and other faults remaining in the sintered material, resulting in Weibull coefficient of the throw-away tip lower than 5. When the firing temperature C is higher than 1600° C., the material is over-sintered with roughened surface, and the Weibull coefficient of the throw-away tip becomes lower.

When firing under the firing conditions described previously, use of a solid solution of Co and Ni as the material improves the sintering performance and enables it to prevent the occurrence of open pores on the surface of the sintered material and sintering defects from being generated.

The cermet substrate thus obtained is, after being subjected to surface treatment such as polishing as required, coated with single or multi carbonitride coating layer by chemical deposition or physical deposition process, thereby to make the throw-away tip made of cermet according to the present invention. As the coating method, physical deposition process which involves less reaction with the cermet substrate is preferably employed in order to form the carbonitride coating layer consisting of fine grains.

The throw-away tip manufactured in the process described above has a shape of substantially flat plate made of cermet consisting of a carbonitride phase, comprising composite metal carbonitride of Ti and at least one kind of metals of groups 4a, 5a and 6a of the Periodic Table other than Ti, held together by the binder phase consisting of Co and Ni. The throw-away tip has a mean grain size of the carbonitride phase of 1.5 μm or less, preferably from 0.3 to 1.0 μm, while flexural strength test pieces which are cut out of ten throw-away tips show flexural strength with a Weibull coefficient of 5 or higher, preferably 7 or higher and more preferably 10 or higher, having small variance in characteristics.

Preferred embodiment of the present invention is directed to a throw-away tip satisfying the following constituent features (a) to (d) used for machining a workpiece with a cutting edge applied thereto:

(a) 1 to 30% by weight of a binder phase comprising at least one kind of Co and Ni, and 70 to 99% by weight of a carbonitride phase comprising carbonitride of Ti and one or more kind other than Ti among metals of groups 4a, 5a and 6a of the Periodic Table are contained;

(b) a mean grain size of the carbonitride phase is 1.5 μm or less;

(c) the shape is substantially flat plate; and (d) flexural strength test pieces that are cut out of ten throw-away tips including the side faces of the throw-away tips show a Weibull coefficient of 5 or higher for the flexural strength.

The Weibull coefficient of flexural strength mentioned above are calculated according to JIS R1625 from measurements made per JIS R1601 for other than shape of the test pieces (10 or more test pieces having shape of rectangular prism that can be cut out of the throw-away tip) that are cut out of the throw-away tip including the side face thereof.

Here, the test pieces defined to JISR1601 have the relation that a sectional surface (length and width) and span during flexural strength test is in proportion of vertical:horizontal: span:=3 mm:4 mm:30 mm. The side face (relief surface) is provided on the tensile surface (opposite to the loaded surface), the load is applied from the central part on the upper surface of the test piece where the interval (span) of the supports which support the undersurface (the tensile surface) of the test piece is set to 30 mm, and the load into which the test piece breaks is measured.

However, the size of many of slow away tips is small, and therefore the size of the test piece which is specified to JISR1601 cannot be taken in many cases. In such a case, the form of the test piece is the greatest square pillar form which can be cut off of the throw-away tip including the side face (relief surface) with proportion of vertical:lateral:span=3:4:30.

In cutting tools, such as an end mill and a drill, other than a slow-away tip, with which from the cutting edge to the shank part is formed by the cermet, the test piece performing the above-mentioned flexural test is cut off of the throw-away tip including the surface with proportion of vertical:lateral: span=3:4:30.

In the throw-away tip made of cermet according to this embodiment, largest crystal grain size that can become the fracture origin such as abnormal grains and voids that are observed in fracture surface of the throw-away tip after flexural strength test is 10 μm (diameter) or less, preferably 5 μm (diameter) or less and more preferably 3 μm (diameter) or less. This increases the flexural strength of the cermet, and improves the chipping resistance of the throw-away tip. As a result, a Weibull coefficient of the throw-away tip can be increased and variance in the cutting performance of the throw-away tip can be reduced.

It is preferable that the cermet substrate has a binder alloy enriched zone on the surface thereof where concentration of the binder phase (Co content+Ni content) gradually increases. That is, the cermet has a surface zone of binder alloy enrichment. This enables it to mitigate the shearing stress generated between the carbonitride coating layer and the cermet substrate so as to greatly increase the bonding strength between the carbonitride coating layer and the cermet substrate, and improve the chipping resistance of the throw-away tip.

In order to increase the heat conductivity of the surface of the TiCN-based cermet substrate where the temperature tends to become high due to a low heat conductivity while maintaining the bonding strength of the carbonitride coating layer, it is preferable that the thickness of the binder alloy enriched zone is in a range from 0.01 to 5 μm, and preferably from 1 to 3 μm. Further, in order to suppress plastic deformation of the edge of the cutting tool, it is preferable that the thickness of the binder alloy enriched zone is in a range from 1 to 2.5 μm.

The content of the binder phase is preferably from 1 to 30% by weight in view of sintering performance, wear resistance and resistance against plastic deformation. When the content of the binder phase is less than 1% by weight, desired levels of strength and wear resistance cannot be achieved. When the content of the binder phase exceeds 30% by weight, wear resistance may decrease drastically. Preferable content of the binding phase is in a range from 4 to 20% by weight.

The cermet used for the throw-away tip of the present invention has the carbonitride phase made of composite metal carbonitride of Ti and at least one kind selected from among a group of metals of groups 4a, 5a and 6a of the Periodic Table other than Ti, particularly at least one kind selected from among W, Zr, V, Ta, Nb and Mo. The carbonitride phase, in particular, is preferably made in double-core or triple core structure constituted from a core made of Ti(TiCN) and a peripheral region made of a compound consisting of Ti and at least one kind of W, Mo, Ta and Nb, since this constitution has the effect of controlling the grain growth, enables it to form fine and homogeneous structure of the cermet substrate, and contributes to increasing the strength of bonding with the binding phase and the strength of cermet. According to the present invention, the existence of a small amount of at least one kind selected from carbide phase and nitride phase may be recognized into the carbonitride phase.

In consideration of bonding strength with the carbonitride coating layer, improvements of heat conductivity and suppression of plastic deformation, it is preferable that the mean grain size $r_1$ of the carbonitride phase on the surface of the cermet substrate is larger than the mean grain size $r_2$ inside of the cermet substrate, and it is more preferable that $r_1$=0.5 to 2 μm, and $r_2$=0.2 to 1 μm.

Further according to the present invention, the cermet substrate may be coated on the surface thereof with a carbonitride coating layer (hereafter referred to as Ti-based coating layer) having composition of $(Ti_x, M_{1-x})(C_yN_{1-y})$ (where M represents at least one kind of Al, Si and metal of groups 4a, 5a and 6a of the Periodic Table other than Ti, $0.4 \leqq x \leqq 1$, $0 \leqq y \leqq 1$). The Ti-based coating layer is preferably formed right above the base material of cermet. Moreover, it is preferable to provide coating with carbonitride coating layer made of (Ti, M1)N (where M1 represents one kind selected from among Al, Si, Zr and Cr), preferably made of $(Ti_x, Al_{1-x})$ in or to ensure high hardness and high heat resistance including high temperature stability.

The carbonitride coating layer may be, besides the Ti-based coating layer, made of one of diamond, cubic boron nitride, alumina, carbide, nitride and carbonitride of Zr, Hf, Cr or Si.

Second Embodiment

Cermet of this embodiment is comprised from 1 to 30% by weight of binder phase comprising at least one kind of Co and Ni and 70 to 99% by weight of a carbonitride phase comprising composite metal carbonitride of Ti and at least one kind of metals of groups 4a, 5a and 6a of the Periodic Table other than Ti. Main features of the cermet are that a mean grain size of the carbonitride phase is 1.5 μm or less, preferably from 0.3 to 1.0 μm, while at least 50%, particularly 80% or more of the fracture origins observed in the fracture surface of the flexural strength test pieces which are out of the cermet consist of voids of which part or entire wall surface is covered by coating film made of the binder phase (hereafter referred to as a binder phase film) after the flexural strength test. This constitution enables it to cause coarse voids that are the most significant cause of variance in characteristics of the fine-grain cermet to become less likely to be destroyed, so as to minimize the influence of the fracture origin in the sintered material and thereby suppress the variance in characteristics of the cermet.

As a result, it is made possible that flexural strength test pieces which are cut out of ten throw-away tips made of the cermet as the base material show flexural strength with a Weibull coefficient of 5 or higher, preferably 7 or higher and more preferably 10 or higher, with small variations in characteristics.

That is, when the fracture origin is voids covered with the binder phase film in the wall surface, variation in flexural strength can be made small, and the characteristics of the cermet becomes homogeneous, since voids are hard to be destroyed. In case the fracture origin is abnormal grains generated by grain growth, or the wall surface is not covered by the binder phase film, the abnormal grains or voids can be destroyed by a small load, tending to result in significant variations in the flexural strength among the test pieces, which means partially inhomogeneous characteristic of the cermet.

The flexural strength test of the cermet is not necessarily required to be conducted in accordance to the JIS standard. While flexural strength test may be conducted on cermet of any shape by any method, it is preferable to employ a test method similar to 3 point bending strength test since it enables it to reliably identify the fracture origin. An example of method for measuring the flexural strength of the throw-away tip is, similarly to that of the first embodiment, to make measurement according to JIS R 1601 except for such a shape of the test piece as the test pieces are cut into a shape of rectangular prism that can be cut out of the throw-away tip including the side face (flank).

The size of coarse voids that make the fracture origin that are observed in fracture surface of the throw-away tip after flexural strength test is 10 μm or less, preferably 5 μm or less and more preferably 3 μm or less. This increases the Weibull coefficient of the throw-away tip and reduce the variations in the cutting performance of the throw-away tip.

It is also preferable that the binder phase film surface of the void wall that can become the fracture origin has wave pattern at interval of 0.5 μm or less, which has the effect of suppressing the development of cracks. Also in order to increase the bonding strength the voids and the binder phase film and improve the effect of suppressing the cracks, it is desirable that there are pin holes sparsely distributed in the binder phase film and there are carbonitride phases protruding in the pin holes.

In order to suppress the development of cracks, the mean thickness of the binder phase film is preferably 5 μm or less and more preferably 3 μm or less. While the binder phase film contains at least one kind of cobalt and nickel, the total content of metal elements that constitute the carbonitride phase, particularly titanium, tungsten, molybdenum and chromium is preferably from 1 to 20% by weight, in order to increase the strength of the binder phase film.

Method for manufacturing the throw-away tip is substantially the same as that of the first embodiment. That is, the carbonitride phase forming components consisting of at least one kind selected from among TiCN powder and carbide powder, nitride powder and carbonitride powder that contain at least one kind of metal of groups 4a, 5a and 6a of the Periodic Table other than Ti, particularly Ti, particularly at least one kind selected from among W, Mo, Ta, V, Zr and Nb, and the binder phase forming components contains at least one kind of_Co and Ni powder are weighed and mixed in predetermined proportions. The mean particle size of the TiCN powder, the mean particle size of the binder phase forming components and the proportion of the carbonitride phase forming components and the binder phase forming components may also be substantially the same as those of the first embodiment.

In order to obtain the cermet having the structure described above, the carbon content in the binder phase forming components is controlled to fall within a range from 0.02 to 0.40% by weight preferably from 0.15 to 0.30% by weight. When the carbon content in the binder phase forming component powder is less than 0.02% by weight, the binder phase film is not formed on the wall surface of the voids that are generated in the sintered material and the voids can be broken with a small load. When the carbon content in the binder phase forming component powder is more than 0.40% by weight, voids having sizes of 200 μm or more are generated in the sintered material and there arise variations in the flexural strength of the sintered material, thus causing significant variations in the cutting performance among the throw-away tips.

This embodiment is the same as the first embodiment with other respects.

Third Embodiment

The throw-away tip (cutting tool) of this embodiment is made of TiCN-based cermet constituted from a binder phase including at least one kind of_Co and Ni and a carbonitride phase made of carbonitride of mainly Ti and other metals of groups 4a, 5a and 6a of the Periodic Table, and is particularly suited for rough cutting operations.

Rough cutting operation according to the present invention refers to machining operation, particularly turning, carried out under wet or dry cutting condition with feed rate of 0.30 mm per revolution or more, infeed of 2.0 mm or more and cutting speed of 250 m/min or more.

In order to make a cutting tool suitable for such rough cutting operation, it is important that the TiCN-based cermet contains Co and Ni in total content from 15 to 22% by weight. When the content of the binder phase is less than 15% by weight, desired strength and impact resistance cannot be achieved. When the content of the binder phase is more than 22% by weight, wear resistance decreases drastically. In either case, use of this material to make a tool for rough cutting operations leads to chipping, plastic deformation and wear of the tool edge, and sufficient cutting performance cannot be obtained. The content of Co and Ni is preferably in a range from 16 to 20% by weight, and more preferably in a range from 17 to 19.5% by weight.

The cermet contains 55 to 80% by weight of Ti in proportion to the total content of metals of groups 4a, 5a and 6a of the Periodic Table. When the content of Ti is less than 55% by weight, strength required for rough cutting operation cannot be achieved. When the content of Ti is more than 80% by weight, toughness may decrease resulting in low impact resistance during rough cutting operation. Content of Ti is preferably in a range from 65 to 77% by weight.

The metals of groups 4a, 5a and 6a of the Periodic Table including Ti constitute the composite metal carbonitride of the carbonitride phase. The carbonitride phase is preferably made in double-core or triple core structure constituted from a core made of TiCN and a peripheral region made of at least one kind of composite carbide, composite nitride and composite carbonitride of Ti and at least one kind of metals of groups 4a, 5a and 6a of the Periodic Table, particularly W, Mo, Ta and Nb, since this constitution has the effect of controlling the grain growth, enables it to form fine and homogeneous structure of the cermet substrate, and contributes to increasing the strength of bonding with the binder phase and the strength of cermet.

The mean crystal grain size of the carbonitride phase in the central portion of the cutting tool is in a range from 0.5 to 1 μm, preferably form 0.6 to 0.9 μm and more preferably from 0.7 to 0.9 μm. When mean crystal grain size of the carbonitride phase is smaller than 0.5 μm, the carbonitride phase tends to agglomerate resulting in inhomogeneous structure with low impact resistance and low hardness of the cermet, thus leading to lower chipping resistance and lower wear resistance of the cutting tool. When mean crystal grain size of the carbonitride phase is larger than 1 μm, strength of the cermet decreases and chipping resistance of the throw-away tip decreases.

In the cutting tool of the present invention, it is desirable that there is a binder alloy enriched zone on the surface of the cermet where concentration of the binder phase gradually increases, similar to the first embodiment. Presence of the binder alloy enriched zone enables it to increase the heat conductivity of the cutting edge of the cutting tool, so as to increase heat dissipation from the cutting edge, thereby improving the chipping resistance under harsh cutting conditions of rough cutting. This gives rise to another effect of making the machined surface of the workpiece smoother as the cutting edge undergoes a slight deformation with respect to the workpiece surface. The thickness of the binder alloy enriched zone in the outermost layer is preferably in the range from 0.01 to 5 μm, more preferably from 1 to 3 μm and most preferably from 1 to 2.5 μm, as a region containing 1.1 times or more binder phase than the central portion of the cutting tool, in order to increase the heat conductivity and prevent the cutting edge of the tool from undergoing an excessive plastic deformation.

In consideration of bonding strength with the carbonitride coating layer to be described later, improvement of the heat conductivity and suppression of plastic deformation, it is preferable that mean crystal grain size $r_1$ of the carbonitride phase on the surface of the cermet substrate is larger than the mean crystal grain size $r_2$ of the carbonitride phase in the central portion of the cermet substrate, specifically $r_1$–0.5 to 2 μm.

Further according to the present invention, the cermet substrate may be coated on the surface thereof with carbonitride coating layer (Ti-based coating layer) having composition of $(Ti_x, M_{1-x})(C_y N_{1-y})$ (where M, x and y are defined the same as in the first embodiment). The coating layer is preferably formed right above the base material of cermet. Moreover, it is preferable that M is one kind selected from Al, Si, Zr and Cr, and is most preferably Al, in order to achieve high hardness and heat resistance including high temperature stability.

The carbonitride coating layer may be, besides the T-based coating layer, another carbonitride coating layer comprising at least one kind of diamond, cubic boron nitride, alumina, carbide, nitride and carbonitride of Zr, Hf, Cr or Si.

To manufacture the cutting tool made of the TiCN-based cermet of the present invention, TiCN powder and at least one kind of powder selected from among a group consisting of carbide, nitride and carbonitride of metals of groups 4a, 5a and 6a of the Periodic Table are weighed and mixed so that the content of Ti is from 55 to 80% by weight, particularly from 65 to 77% by weight in proportion to the total content of metals of groups 4a, 5a and 6a of the Periodic Table, as the carbonitride phase forming components. A ratio N/(C+N) of nitrogen (N) to carbon (C) in the carbonitride phase forming components is controlled to fall within a range from 0.4 to 0.6.

The TiCN powder must be a fine powder having a mean particle size from 0.4 to 1.0 μm. When the TiCN powder has a mean particle size larger than 1.0 μm, it is difficult to keep the mean crystal grain size of the carbonitride phase in the cermet within 1.0 μm. When the mean particle size of the TiCN powder is small than 0.4 μm, it is difficult to keep the mean crystal grain size of the carbonitride phase to 0.5 μm or larger.

It is appropriate that mean particle size of at least on kind of powder selected from among a group consisting of carbide, nitride and carbonitride of metals of groups 4a, 5a and 6a of the Periodic Table is in a range from 0.5 to 2 μm.

Powder of at least one kind of Ni and Co having a mean particle size in a range from 0.3 to 4 μm is added in a proportion of 15 to 22% by weight as the binder phase forming components.

These powders are mixed in a ball mill or the like, formed into the predetermined shape of the cutting tool by a known molding method such as press molding or extrusion molding, and the green compact is then fired.

Firing is preferably carried out, in order to form the carbonitride phase of cored structure and suppress the grain growth of the carbonitride phase, in such a process as increasing the temperature from the room temperature to about 950° C. at a rate of 10 to 15° C./min. in vacuum of 0.01 Torr, then increasing the temperature to about 1300° C. at a rate of 1 to 5° C./min., then increasing the temperature to a level from 1500 to 1600° C. at a rate from 3 to 15° C./min. and, after keeping this temperature for one hour or less, the temperature is decreased to the room temperature at a rate of 10 to 15° C./min.

In order to form a binder phase enriched zone on the surface of the cermet, under the firing conditions described above, it is preferable to carry out the step of raising the temperature from the room temperature to a level from 1250 to 1350° C. in nitrogen gas atmosphere of 0.1 to 0.3 kPa, carry out only the step of raising the temperature from a level of 1250 to 1350° C. to level of 1500 to 1600° C. in vacuum of 0.01 Torr or lower so as to fire at a temperature from 1500 to 1600° C., and lower the temperature to the room temperature at a rate of 10 to 15° C./min., in vacuum of 0.01 Torr or lower.

The TiCN-based cermet made by the method described above may be coated with the coating layer formed by chemical vapor deposition process (CVD process) or physical vapor deposition process (PVD process) such as sputtering, ion plating or vapor deposition.

Fourth Embodiment

The throw-away tip (cutting tool) of this embodiment is made of TiCN-based cermet constituted from a binder phase including at least one kind of Co and Ni and a carbonitride phase comprising carbonitride of mainly Ti and other metals of groups 4a, 5a and 6a of the Periodic Table. The throw-away tip is suited for finishing operations.

A finishing operation according to the present invention refers to machining operation, particularly turning, carried out under wet or dry cutting condition with a feed rate from 0.01 to 0.25 mm per revolution, an infeed from 0.01 to 1.8 mm and a cutting speed from 50 to 500 m/min.

In order to make a cutting tool suitable for such finishing operation, it is important that the TiCN-based cermet contains Co and Ni in total content from 4 to 14% by weight. When the content of the binder phase is less than 4% by weight, strength and impact resistance tend to be lower. When the content of the binder phase is more than 14% by weight, wear resistance in finishing operation decreases drastically. In either case, use of this material to make tool for finishing operations leads to chipping or plastic deformation of the tool edge, resulting wearing out, and sufficient cutting performance cannot be obtained. Content of Co and Ni is preferably in a range from 5 to 12% by weight, and more preferably in a range from 6 to 10% by weight, in order to finish the workpiece with smoother surface.

It is important that the cermet contains 55 to 80% by weight of Ti in an amount based on the total content of metals of groups 4a, 5a and 6a of the Periodic Table. When the content of Ti is less than 55% by weight, strength required for finishing operation cannot be maintained. When the content of Ti is more than 80% by weight, toughness decreases resulting in low impact resistance during high speed finishing operation in which heat generated by machining poses a problem. Content of Ti is preferably in a range from 65 to 77% by weight in order to improve the surface finish on the workpiece.

The metals of groups 4a, 5a and 6a of Periodic Table including Ti constitute the composite metal carbonitride of the carbonitride phase. The carbonitride phase is preferably made in double core or triple core structure constituted from (1) a core made of TiCN and (2) a peripheral region made of at least one kind of carbide, nitride and carbonitride of Ti and at least one kind of metals of groups 4a, 5a and 6a of the Periodic Table, particularly at least one kind of W, Mo, Ta and Nb, since this constitution has the effect of controlling the grain growth, enables it to form fine and homogeneous structure of the cermet substrate, and contributes to increasing the strength of bonding with the binder phase and the strength of cermet.

The mean crystal grain size of the carbonitride phase in the central portion of the cermet is in a range from 0.5 to 1 μm, preferably from 0.6 to 0.9 μm and more preferably from 0.7 to 0.9 μm. When the mean crystal grain size of the carbonitride phase is smaller than 0.5 μm, the carbonitride phase tends to agglomerate resulting in inhomogeneous structure with lower impact resistance and lower hardness of the cermet, thus leading to lower chipping resistance and lower wear resistance of the cutting tool. When mean crystal grain size of the carbonitride phase is larger than 1 μm, strength of the cermet decreases and chipping resistance of the throw-away tip decreases.

In the cutting tool of the present invention, it is desirable that there is a surface layer where concentration of metal tungsten gradually increases from the inside of the sintered cermet to the surface. Presence of such a surface layer enables it to increase the heat conductivity in the surface, so as to increase the dissipation of heat generated by the machining operation and minimize thermal expansion, thereby to suppress the thermal expansion and shrinkage cycle of the cutting edge and prevent cracks from being generated by the thermal cycle. This constitution is particularly effective for high speed finishing operation and cutting of a hard-to-cut metal in which much heat is generated.

The depth of the surface layer is preferably from 30 to 60 μm in order to satisfactorily dissipate the heat generated by the machining operation, and more preferably from 30 to 45 μm in order to minimize the thermal expansion.

In consideration of bonding strength with the carbonitride coating layer to be described later, improvement of heat conductivity and suppression of plastic deformation, it is preferable that mean crystal grain size $r_1$ of the carbonitride phase on the surface of the cermet substrate is larger than the mean crystal grain size $r_2$ of the carbonitride phase in the central portion of the cermet substrate, specifically $r_1$=0.5 to 2 μm.

Moreover, it is preferable that the cermet substrate is coated on the surface thereof with carbonitride coating layer (Ti-based coating layer) having composition of $(Ti_x, M_{1-x})(C_yN_{1-y})$ (where M, x and y are defined the same as described previously). The coating layer is preferably formed right above the base material of cermet.

The carbonitride coating layer may be, besides the T-based coating layer, made of another carbonitride coating layer comprising at least one kind of diamond, cubic boron nitride, alumina, carbide, nitride and carbonitride of Zr, Hf, Cr or Si.

The throw-away tip made of the TiCN-based cermet of this embodiment can be manufactured similarly to the third embodiment, except for adding 4 to 14% by weight of at least one kind of Ni and Co powder.

The following examples further illustrate the manner in which the present invention can be practiced. It is understood, however, that the examples are for the purpose of illustration and the inventions are not to be regarded as limited to any of the specific materials or condition therein.

EXAMPLE I

TiCN powder having a mean particle size (d) and the oxygen content shown in Table 1, TiN powder, TaC powder, NbC powder, WC powder, ZrC powder and VC powder, all of which having a mean particle size from 0.5 to 2 μm, and Co/Ni alloy powder (metal Co powder and metal Ni powder both having a mean particle size of 0.5 μm in the case of samples Nos. 6 and 16) having a mean particle size (d) shown in Table 1 were mixed in proportion shown in Table 1. The mixed powder was crushed and mixed in a ball mill in a wet process. This crushing and mixing process was carried out until such a particle size distribution measured by micro track method where proportion of particles of 1 μm or larger is as shown in Table 1 is achieved, while changing the crushing time.

The mixed powder was molded by pressing at a pressure of 98 MPa, with the green compacts being fired under the conditions shown in Table 1, thereby to make ten samples of cermet (samples Nos. 1-1 to 11) having the shape of CNMG120408.

The samples of cermet made in the same process as described above were coated with a carbonitride coating layer of TiAlN having a thickness of 2.4 μm formed by ion plating process using are discharge, thereby making ten throw-away tips made of cermet with the surface being coated (sample No. 1-12).

From each throw-away tip made as described above, two flexural strength test pieces (width of rake face 0.75 mm, flank width 1 mm, flank length 10 mm) including the side face (flank), totaling 20 test pieces (10 throw-away tips×2 pieces) were cut out. The test pieces were subjected to 3-point bending test with the flank located on the tensile side and span of 7.5 mm in accordance to JIS R1601 except for the shape of the test piece, and the Weibull coefficient was calculated in accordance to the JIS R1625. Fracture surface of the test piece after the flexural strength test was observed with SEM so as to identify the fracture origin and determine the maximum size of crystal grain where the fracture originated. Results of the test are shown in Table 2.

Cutting test under the cutting conditions A described below was conducted on ten throw-away tips manufactured under conditions similar to those described above.

Cutting conditions A

Workpiece material: S45C

Workpiece shape: Round rod with four slots

Cutting speed: 100 m/min.

Feed rate and cutting time: After cutting for 10 seconds with feed rate of 0.1 mm/rev., feed rate was increase by a step of 0.05 mm/rev. while cutting for 10 seconds for each increment (till maximum feed rate of 0.5 mm/rev. was reached).

Infeed: 2 mm

Evaluation: Total cutting time before chipping (mean duration, variance)

TABLE 1

| | TiCN | | Carbonitride Phase Forming Component (wt %) | | | | | | | Binder Phase Forming Component | | |
|---|---|---|---|---|---|---|---|---|---|---|---|---|
| Sample No. | d (μm) | Oxygen Content (wt %) | TiCN | TiN | TaC | NbC | WC | ZrC | VC | Ni (wt %) | Co (wt %) | d (μm) |
| I-1 | 0.7 | 0.91 | 40 | 20 | 3 | 2 | 14 | 2 | 1 | 8 | 10 | 0.5 |
| I-2 | 0.7 | 0.49 | 40 | 20 | 3 | 2 | 14 | 2 | 1 | 8 | 10 | 0.5 |
| I-3 | 0.7 | 0.98 | 45 | 13 | 2 | 2 | 15 | 3 | 1 | 7 | 12 | 0.5 |
| I-4 | 0.7 | 0.51 | 45 | 13 | 1 | 3 | 15 | 3 | 1 | 7 | 12 | 0.5 |
| I-5 | 0.7 | 0.51 | 50 | 15 | 3 | 2 | 9 | 2 | 1 | 8 | 10 | 0.5 |
| I-6 | 0.7 | 0.05 | 50 | 5 | — | 2 | 12 | 2 | 1 | 8 | 10 | 0.5/0.5 |
| I-7 | 0.7 | 0.13 | 50 | 15 | 3 | 2 | 9 | 2 | 1 | 8 | 10 | 0.5 |
| I-8 | 0.7 | 0.88 | 50 | 15 | 2 | 2 | 12 | — | — | 7 | 12 | 0.5 |
| I-9 | 0.7 | 0.90 | 50 | 12 | 3 | — | 14 | 2 | 1 | 6 | 12 | 0.5 |
| I-10 | 0.7 | 0.50 | 50 | 15 | — | — | 14 | 1 | 1 | 5 | 14 | 0.5 |
| I-11 | 0.7 | 0.67 | 50 | 15 | 3 | 2 | 9 | 2 | 1 | 8 | 10 | 0.5 |
| I-12 | 0.7 | 0.95 | 50 | 15 | 3 | 2 | 9 | 2 | 1 | 8 | 10 | 0.5 |
| *I-13 | 0.7 | 1.22 | 50 | 15 | 2 | 2 | 12 | — | — | 5 | 14 | 0.5 |
| *I-14 | 0.7 | 0.94 | 50 | 12 | 3 | — | 14 | 2 | 1 | 7 | 11 | 0.5 |
| *I-15 | 1.5 | 0.88 | 50 | 15 | 3 | 2 | 9 | 2 | 1 | 8 | 10 | 0.5 |
| *I-16 | 0.7 | 0.78 | 45 | 13 | 2 | 2 | 15 | 3 | 1 | 7 | 12 | 0.5/0.5 |
| *I-17 | 0.7 | 0.69 | 40 | 20 | 3 | 2 | 14 | 2 | 1 | 8 | 10 | 2.0 |
| *I-18 | 0.7 | 0.12 | 40 | 20 | 3 | 2 | 14 | 2 | 1 | 8 | 10 | 0.5 |

TABLE 1-continued

| | | | | | | | | | | | | |
|---|---|---|---|---|---|---|---|---|---|---|---|---|
| *I-19 | 0.7 | 0.12 | 50 | 15 | 3 | 2 | 9 | 2 | 1 | 9 | 9 | 0.5 |

| | | Firing Conditions | | | | | |
|---|---|---|---|---|---|---|---|
| Sample No. | Particles of 1 μm or Larger (wt %) | Firing Temperature A (° C.) | Raising rate of Temperature a (° C./min) | Firing Temperature B (° C.) | Raising rate of Temperature b (° C./min) | Firing Temperature C (° C.) | Raising rate of Temperature c (° C./min) |
| I-1 | 9 | 1250 | 0.7 | 1400 | 5 | 1500 | 4 |
| I-2 | 5 | 1100 | 1.5 | 1500 | 10 | 1600 | 6 |
| I-3 | 9 | 1200 | 1 | 1450 | 15 | 1550 | 14 |
| I-4 | 5 | 1100 | 1.5 | 1400 | 10 | 1550 | 8 |
| I-5 | 9 | 1200 | 1 | 1400 | 12 | 1500 | 8 |
| I-6 | 10 | 1200 | 1 | 1500 | 15 | 1600 | 13 |
| I-7 | 8 | 1250 | 0.8 | 1450 | 15 | 1550 | 7 |
| I-8 | 8 | 1150 | 2 | 1400 | 10 | 1600 | 4 |
| I-9 | 7 | 1200 | 1 | 1450 | 15 | 1550 | 9 |
| I-10 | 5 | 1100 | 1 | 1400 | 10 | 1600 | 4 |
| I-11 | 7 | 1200 | 1 | 1450 | 5 | 1550 | 4 |
| I-12 | 9 | 1200 | 1 | 1450 | 15 | 1550 | 14 |
| *I-13 | 10 | 1150 | 1.5 | 1400 | 10 | 1550 | 8 |
| *I-14 | 10 | 1200 | 1 | 1300 | 15 | 1600 | 10 |
| *I-15 | 25 | 1200 | 1 | 1450 | 15 | 1550 | 14 |
| *I-16 | 9 | 1200 | 1 | 1400 | 3 | 1650 | 15 |
| *I-17 | 7 | 1150 | 1.5 | 1400 | 10 | 1550 | 8 |
| *I-18 | 9 | 1150 | 1.5 | 1400 | 10 | 1450 | 8 |
| *I-19 | 10 | 1200 | 0.3 | 1400 | 12.5 | 1650 | 10 |

Sample numbers marked with * are not within the scope of the present invention.

TABLE 2

| | | | | | Cutting Time Before Chipping (Sec) | | |
|---|---|---|---|---|---|---|---|
| Sample No. | Mean Grain Size of Carbonitride Phase (μm) | Flexural Strength (MPa) | Weibull Coefficient | Fracture Origin (μm) | Mean | Variance (Standard Deviation σ) | Remarks |
| I-1 | 0.8 | 2495 | 12.1 | 4.1 | 84 | 4.5 | |
| I-2 | 0.6 | 2583 | 12.9 | 3.0 | 88 | 2.5 | |
| I-3 | 0.9 | 2384 | 8.5 | 8.2 | 77 | 5.3 | |
| I-4 | 0.6 | 2651 | 13.3 | 2.8 | 88 | 2.6 | |
| I-5 | 0.8 | 2387 | 10.4 | 3.8 | 81 | 4.1 | |
| I-6 | 0.9 | 2215 | 7.1 | 7.1 | 75 | 5.1 | |
| I-7 | 0.8 | 2511 | 11.4 | 3.5 | 86 | 4.8 | |
| I-8 | 0.8 | 2418 | 10.9 | 3.8 | 85 | 4.5 | |
| I-9 | 0.9 | 2190 | 5.1 | 9.4 | 71 | 6.1 | |
| I-10 | 0.7 | 2720 | 15.3 | 2.1 | 96 | 2.1 | |
| I-11 | 0.8 | 2362 | 9.8 | 3.9 | 83 | 3.2 | |
| I-12 | 0.9 | 2295 | 8.2 | 7.5 | 73 | 5.7 | TiAlN Coating |
| *I-13 | 1.2 | 1934 | 4.9 | 14 | 59 | 20.6 | |
| *I-14 | 1.8 | 1764 | 3.5 | 19 | 47 | 15.3 | |
| *I-15 | 2.2 | 1691 | 2.8 | 24 | 41 | 13.5 | |
| *I-16 | 1.7 | 1491 | 15 | 51 | 38 | 16.8 | |
| *I-17 | 1.1 | 2492 | 4.5 | 5.8 | 73 | 17.4 | |
| *I-18 | 1.0 | 2574 | 4.1 | 4.9 | 81 | 14.8 | |
| *I-19 | 1.3 | 2391 | 4.5 | 5.2 | 69 | 19.3 | |

Sample numbers marked with * are not within the scope of the present invention.

The results shown in Table 1 and Table 2 indicate that all samples Nos. 1-1 to 12 having flexural strength with Weibul coefficient of 5 or higher demonstrated good cutting performance of mean time before chipping 71 minutes or more with insignificant variation of 6.1 or less standard deviation in cutting performance. In contrast, samples Nos. 1-13 to 19 having a flexural strength with a Wiebull coefficient less that 5 showed significant variations in the cutting performance among throw-away tips, with standard deviation of 13.5 or more.

EXAMPLE II

TiCN powder having a mean particle size shown Table 3, TiN powder, TaC powder, NbC powder, WC powder, $Mo_2C$ powder, ZrC powder and VC powder, all of which having a mean particle size from 0.5 to 2 μm, and Co/Ni alloy powder having a mean particle size and carbon content shown in Table 1 (metal Co powder and metal Ni powder both having a mean particle size of 0.5 μm in the case of samples Nos. 6 and 16) were mixed in proportion shown in Table 1 in a ball mill in a wet process, with the crushing process being carried out until such a particle size distribution measured by micro track method where proportion of particles of 1 μm or larger is shown in Table 3 was achieved, while changing the crushing time, with the powder then being dried.

The mixed powder was molded by pressing at a pressure of 98 MPa. The green compacts thus molded were fired under the conditions shown in Table 3 after raising the temperature to 950° C. at a rate of 12° C./min. and raising the temperature from 950° C. to 1300° C. at a rate of 2° C./min., thereby to make ten test pieces of cermet (samples Nos. II-1 to 11, 13 to 19) having the shape of CNMG120408.

Test pieces of cermet made in the same process as described above were coated with hard coating layer of TiAIN having a thickness of 2.4 μm formed by ion plating process using arc discharge, thereby making ten throw-away tips made of cermet with the surface being coated (sample No. II-12).

From each throw-away tip made as described above, two flexural strength test pieces (width of rake face 3.5 mm. flank width 2.5 mm, flank length 10 mm) including the side face, totaling 20 test pieces (10 throw-away tips×2 pieces) were cut out. The test pieces were subjected to 3-point bending test in accordance to the JIS R1601 except for the shape of the test piece, and the Weibull coefficient was calculated in accordance to JIS R1625. Fracture surface of the test piece after the flexural strength test was observed with SEM so as to identify the fracture origin and determine the size of the fracture origin. Results of the test are shown in Table 4.

Cutting test under the same cutting conditions as those of the first example was conducted on ion throw-away tips manufactured under conditions similar to those described above, so as to evaluate the cutting performance.

TABLE 3

| Sample No. | TiCN d (μm) | Carbonitride Phase Forming Component (wt %) | | | | | | | | Binder Phase Forming Component (wt %) | | |
|---|---|---|---|---|---|---|---|---|---|---|---|---|
| | | TiCN | TiN | TaC | NbC | WC | MoC | ZrC | VC | Ni | Co | Carbon Content |
| II-1 | 0.7 | 40 | 20 | 3 | 2 | 14 | | 2 | 1 | 8 | 10 | 0.1 |
| II-2 | 0.7 | 40 | 20 | 3 | 2 | 14 | | 2 | 1 | 8 | 10 | 0.2 |
| II-3 | 0.7 | 45 | 13 | 2 | 2 | 15 | | 3 | 1 | 7 | 12 | 0.1 |
| II-4 | 0.7 | 45 | 13 | 1 | 3 | 15 | | 3 | 1 | 7 | 12 | 0.3 |
| II-5 | 0.7 | 50 | 15 | 3 | 2 | 9 | | 2 | 1 | 8 | 10 | 0.3 |
| II-6 | 0.7 | 50 | 15 | — | 2 | 6 | 6 | 2 | 1 | 8 | 10 | 0.3 |
| II-7 | 0.7 | 50 | 15 | 3 | 2 | 9 | | 2 | 1 | 8 | 10 | 0.3 |
| II-8 | 0.7 | 50 | 15 | 2 | 2 | 12 | | — | — | 7 | 12 | 0.4 |
| II-9 | 0.7 | 50 | 12 | 3 | — | 14 | | 2 | 1 | 6 | 12 | 0.4 |
| II-10 | 0.7 | 50 | 15 | — | — | 14 | | : | 1 | 5 | 14 | 0.3 |
| II-11 | 0.7 | 50 | 15 | 3 | 2 | 9 | | 2 | 1 | 8 | 10 | 0.4 |
| II-12 | 0.7 | 50 | 15 | 3 | 2 | 9 | | 2 | 1 | 8 | 10 | 0.4 |
| *II-13 | 0.7 | 50 | 15 | 2 | 2 | 12 | | — | — | 5 | 14 | 0.5 |
| *II-14 | 0.7 | 50 | 12 | 3 | — | 14 | | 2 | 1 | 7 | 11 | 0.01 |
| *II-15 | 2 | 50 | 15 | 15 | 2 | 9 | | 2 | 1 | 8 | 10 | 0.3 |
| *II-16 | 0.7 | 45 | 13 | 2 | 2 | 8 | 7 | 3 | 1 | 7 | 12 | 0.2 |
| *II-17 | 0.7 | 43 | 20 | 3 | 2 | 14 | | 2 | 1 | 5 | 5 | 0.01 |
| *II-18 | 0.7 | 40 | 20 | 3 | 2 | 14 | | 2 | 1 | 8 | 10 | 0.5 |
| *II-19 | 0.7 | 50 | 15 | 3 | 2 | 9 | | 2 | 1 | 9 | 9 | 0.1 |

| Sample No. | Particles of 1 μm or Larger (wt %) | Firing Conditions | | | | | |
|---|---|---|---|---|---|---|---|
| | | Firing Temperature A (° C.) | Raising rate of Temperature a (° C./min) | Firing Temperature B (° C.) | Raising rate of Temperature b (° C./min) | Firing Temperature C (° C.) | Raising rate of Temperature c (° C./min) |
| II-1 | 9 | 1250 | 0.7 | 1400 | 5 | 1500 | 4 |
| II-2 | 5 | 1100 | 1.5 | 1500 | 10 | 1600 | 6 |
| II-3 | 9 | 1200 | 1 | 1450 | 15 | 1550 | 14 |
| II-4 | 5 | 1100 | 1.5 | 1400 | 10 | 1550 | 8 |
| II-5 | 9 | 1200 | 1 | 1400 | 12 | 1500 | 6 |
| II-6 | 10 | 1200 | 1 | 1500 | 15 | 1600 | 13 |
| II-7 | 8 | 1250 | 0.8 | 1450 | 15 | 1550 | 7 |
| II-8 | 8 | 1150 | 2 | 1400 | 10 | 1600 | 4 |
| II-9 | 7 | 1200 | 1 | 1450 | 15 | 1550 | 9 |
| II-10 | 5 | 1100 | 1 | 1400 | 10 | 1600 | 4 |
| II-11 | 7 | 1200 | 1 | 1450 | 5 | 1550 | 4 |
| II-12 | 9 | 1200 | 1 | 1450 | 15 | 1550 | 14 |
| *II-13 | 10 | 1150 | 1.5 | 1400 | 10 | 1550 | 8 |
| *II-14 | 10 | 1200 | 1 | 1300 | 15 | 1800 | 10 |
| *II-15 | 25 | 1200 | 1 | 1450 | 15 | 1550 | 14 |
| *II-16 | 9 | 1200 | 1 | 1400 | 3 | 1650 | 15 |
| *II-17 | 7 | 1150 | 1.5 | 1400 | 10 | 1550 | 8 |
| *II-18 | 9 | 1150 | 1.5 | 1400 | 10 | 1450 | 8 |
| *II-19 | 10 | 1200 | 0.3 | 1400 | 12.5 | 1650 | 10 |

Sample numbers marked with * are not within the scope of the present invention.

TABLE 4

| Sample No. | Mean Grain Size of Carbonitride Phase (μm) | Flexural Strength (MPa) | Weibull Coefficient | Fracture Origin: Condition (50% or larger) | Fracture Origin: Maximum Diameter (μm) | Fracture Origin: Binder Phase Film | Cutting Time Before Chipping (Sec): Mean | Cutting Time Before Chipping (Sec): Variance (Standard Deviation σ) | Remarks |
|---|---|---|---|---|---|---|---|---|---|
| II-1 | 0.8 | 2495 | 12.1 | Void | 4.1 | Present | 84 | 4.5 | |
| II-2 | 0.6 | 2586 | 2.9 | Void | 3.0 | Present | 88 | 2.5 | |
| II-3 | 0.9 | 2384 | 8.5 | Void | 8.2 | Present | 77 | 5.3 | |
| II-4 | 0.6 | 2551 | 13.3 | Void | 2.8 | Present | 88 | 2.6 | |
| II-5 | 0.8 | 2387 | 10.4 | Void | 3.8 | Present | 81 | 4.1 | |
| II-6 | 0.9 | 2215 | 7.1 | Void | 7.1 | Present | 75 | 5.1 | |
| II-7 | 0.8 | 2511 | 11.4 | Void | 3.5 | Present | 86 | 4.8 | |
| II-8 | 0.8 | 2418 | 10.9 | Void | 3.8 | Present | 85 | 4.5 | |
| II-9 | 0.9 | 2190 | 5.1 | Void | 9.4 | Present | 71 | 6.1 | |
| II-10 | 0.7 | 2720 | 15.3 | Void | 2.1 | Present | 96 | 2.1 | |
| II-11 | 0.8 | 2362 | 9.8 | Void | 3.9 | Present | 83 | 3.2 | |
| II-12 | 0.9 | 2295 | 8.2 | Void | 7.5 | Present | 73 | 5.7 | TiAlN Coating |
| *II-13 | 1.2 | 1934 | 4.9 | Void | 14 | None | 59 | 20.6 | |
| *II-14 | 1.8 | 1764 | 3.5 | Void | 19 | None | 47 | 15.3 | |
| *II-15 | 1.8 | 1691 | 2.8 | Abnormal Grain or Void | 24 | — | 41 | 13.5 | |
| *II-16 | 1.7 | 1491 | 15 | Abnormal Grain or Void | 51 | None | 38 | 16.8 | |
| *II-17 | 1.1 | 2492 | 4.5 | Abnormal Grain or Void | 5.8→42 | None | 73 | 17.4 | |
| *II-18 | 1.0 | 2574 | 4.1 | Abnormal Grain or Void | 4.9→45 | None | 81 | 14.8 | |
| *II-19 | 1.3 | 2391 | 4.5 | Abnormal Grain or Void | 5.2→70 | None | 69 | 19.3 | |

Sample numbers marked with * are not within the scope of the present invention.

Figure 2:
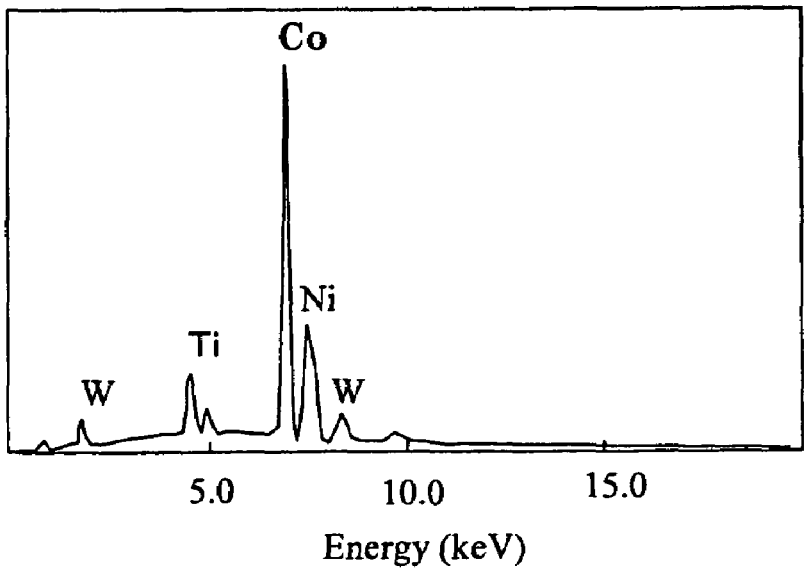
FIG. 2 is a graph showing the result of energy-dispersive spectroscopy (EDX) to identify the constituent elements of the binder phase layer of FIG. 1.

The results shown in tables 3 and 4 indicate that all samples Nos. II-1 to 12, which had the binder phase films formed on the wall surface of the fracture origin according to the present invention, had large mean flexural strength with small variations, and the throw-away tips had good cutting performance with insignificant variations in the cutting performance. In all samples Nos. II-1 to 12, the thickness of the binder phase film was about 0.2 μm while wave pattern at interval 0.1 μm or smaller was formed on the surface and pin holes were sparsely distributed in the binder phase film having a carbonitride phase protruding therein, as shown in FIG. 1 which is a photograph of observing the fracture surface of sample No. II-4 as an example. Also as shown in FIG. 2 that indicates the identification of constituent elements determined by energy-dispersive spectroscopy (EDX) of the binder phase film of FIG. 1, Co was the dominant component of the binder phase film with Ni, Ti and W contained as other components.

Samples Nos. II-13 to 19, in contrast, showed significant variations in the flexural strength and large variations in the performance among throw-away tips.

EXAMPLE III

TiCN powder having a mean particle size shown in Table 5, TiN powder, TaC powder, NbC powder, WC powder, ZrC powder and VC powder, all of which having mean particle size from 0.5 to 2 μm, and Co powder, Ni powder or Co/Ni alloy powder having a mean particle size of 2 μm were crushed and mixed in the proportion shown in Table 5 in a ball mill in a wet process. The mean particle sizes described above were measured by micro track method.

The mixed powder was molded in the shapes of the throw-away tip and the flexural strength test piece by pressing at a pressure of 98 MPa. The green compacts thus molded were fired in such a process as increasing the temperature to 950° C. at a rate of 12° C./min. in vacuum of 0.01 Torr or lower, then increasing the temperature from 950° C. to 1300° C. at a rate of 2° C./min., then increasing the temperature to the firing temperature shown in Table 5 at a rate from 5° C./min. and, after keeping this temperature for one hour, decreasing the temperature to the room temperature at a rate of 12° C./min. in vacuum, thereby to make test pieces of cermet having the shape of CNMG120408. Samples Nos. III-8, 9 were fired in the procedure described above except for carrying out the process of raising the temperature to 1300° C. in nitrogen atmosphere at a pressure of 0.2 KPa.

The test pieces were subjected to 3-point bending test in accordance to the JIS R1601 and toughness (IF method) was measured in accordance to the JIS R1607. The results are shown in Table 6.

Cross section of the throw-away tip thus obtained was observed at the center thereof with an electron microscope, so as to measure the crystal grain size of the carbonitride phase by intercept method at two points in an observing region of 7×7 μm and determine the mean crystal grain size.

Distributions of Ni and Co concentrations of the binder phase near the surface of the throw-away tip were measured by RPMA method. Change in the concentration of Ni+Co, sum of the changes in the concentrations of Ni and Co, was observed and depth of a region where the concentration was 1.1 times that in the central portion or higher was measured at three points with the measurements being averaged.

A cutting test under the rough cutting conditions A described below was conducted on ten throw-away tips. Feed rate at which the throw-away tip was chipped is shown in Table 6.

Cutting conditions

Workpiece material: SCM435

Workpiece shape: Round rod with four slots

Cutting speed: 250 m/min. Feed rate and cutting time: After cutting for 10 seconds with feed rate of 0.1 mm/rev., feed rate was increased by a step of 0.05 mm/rev. while cutting for 10 seconds for each increment (till maximum feed rate of 0.5 mm/rev. was reached). Infeed: 2 mm

TABLE 5

| Sample No. | TiCN Mean Grain Size (μm) | Carbonitride Phase Forming Component (wt %) TiCN | TiN | TaC | NbC | WC | ZrC | VC | Ti/total | Binder Phase Forming Component (wt %) Ni | Co | Ni + Co | Firing Conditions Atmosphere in Process of Raising Temperature | Firing Temperature (° C.) | Atmosphere in Process of Decreasing Temperature |
|---|---|---|---|---|---|---|---|---|---|---|---|---|---|---|---|
| III-1 | 0.5 | 45 | 13 | 0 | 0 | 19 | 3 | 1 | 71.6 | 7 | 12 | 19 | Vacuum | 1500 | Vacuum |
| III-2 | 0.7 | 45 | 13 | 0 | 0 | 19 | 3 | 1 | 71.6 | 7 | 12 | 19 | Vacuum | 1600 | Vacuum |
| III-3 | 0.9 | 45 | 13 | 0 | 0 | 19 | 3 | 1 | 71.6 | 7 | 12 | 19 | Vacuum | 1550 | Vacuum |
| *III-4 | 1 | 45 | 13 | 0 | 0 | 19 | 3 | 1 | 71.6 | 7 | 12 | 19 | Vacuum | 1575 | Vacuum |
| III-5 | 0.7 | 52 | 13 | 0 | 0 | 14 | 1 | 2 | 79.3 | 5 | 13 | 18 | Vacuum | 1575 | Vacuum |
| III-6 | 0.7 | 30 | 30 | 5 | 5 | 10 | 0 | 2 | 73.2 | 10 | 8 | 18 | Vacuum | 1600 | Vacuum |
| III-7 | 0.9 | 50 | 9 | 0 | 5 | 20 | 0 | 0 | 70.2 | 6 | 10 | 19 | Vacuum | 1525 | Vacuum |
| III-8 | 0.7 | 48 | 13 | 1 | 1 | 16 | 0 | 3 | 74.4 | 5 | 13 | 18 | Nitrogen | 1525 | Vacuum |
| III-9 | 0.7 | 54 | 10 | 0 | 1 | 14 | 1 | 2 | 78.0 | 5 | 13 | 18 | Nitrogen | 1600 | Vacuum |
| III-10 | 0.7 | 52.5 | 12 | 1 | 0 | 13 | 0.5 | 3 | 79.1 | 5 | 13 | 18 | Vacuum | 1550 | Vacuum |
| III-11 | 0.7 | 50 | 13 | 0 | 4 | 12 | 1 | 2 | 76.8 | 5 | 13 | 18 | Vacuum | 1575 | Vacuum |
| *III-12 | 0.7 | 12 | 12 | 23 | 23 | 10 | 2 | 0 | 43.0 | 8 | 10 | 18 | Vacuum | 1575 | Vacuum |
| *III-13 | 0.9 | 40 | 15 | 5 | 0 | 10 | 0 | 2 | 80.5 | 6 | 7 | 13 | Vacuum | 1550 | Vacuum |
| *III-14 | 1.5 | 35 | 16 | 10 | 5 | 15 | 3 | 0 | 60.7 | 6 | 10 | 16 | Nitrogen | 1550 | Nitrogen |
| *III-15 | 0.7 | 20 | 19 | 20 | 5 | 5 | 3 | 5 | 50.6 | 8 | 15 | 23 | Nitrogen | 1500 | Nitrogen |
| *III-16 | | 0 | | | | 85 | 0 | 5 | 0.0 | 0 | 10 | 10 | Vacuum | 1500 | Vacuum |

Sample numbers marked with * are not within the scope of the present invention.

TABLE 6

| Sample No. | Mean Grain Size of Carbonitride Phase (μm) | Thickness of Surface Binder Enrichment Phase (μm) | Carbonitride Coating Layer | Mechanical Characteristics Strength (MPa) | toughness ($MPam^{1/2}$) | Cutting Condition A (mm/rev) |
|---|---|---|---|---|---|---|
| III-1 | 0.6 | 1 | — | 2600 | 12 | 0.45 |
| III-2 | 0.8 | 3 | — | 2600 | 12 | 0.45 |
| III-3 | 0.0 | 3 | — | 2500 | 11 | 0.4 |
| *III-4 | 1.2 | 0.05 | — | 2000 | 7 | 0.2 |
| III-5 | 0.8 | 4 | — | 2500 | 13 | 0.5 |
| III-6 | 0.8 | 5 | — | 2800 | 13 | 0.45 |
| III-7 | 0.9 | 2 | — | 2700 | 11 | 0.4 |
| III-8 | 0.9 | 0 | — | 2500 | 12 | 0.4 |
| III-9 | 0.8 | 0 | — | 2400 | 10 | 0.45 |
| III-10 | 0.9 | 2 | $(Ti_{0.5}Al_{0.5})N$ | 2600 | 11 | 0.4 |
| III-11 | 0.7 | 3 | $(Ti_{0.5}Al_{0.5})N$ TiN | 2700 | 12 | 0.45 |
| *III-12 | 0.8 | 0.01 | — | 1900 | 6 | 0.25 |
| *III-13 | 0.9 | 8 | — | 1500 | 11 | Wear |
| *III-14 | 2.2 | 2 | — | 1700 | 4 | 0.15 |
| *III-15 | 0.8 | 9 | — | 1400 | 10 | Wear |
| *III-16 | (Cemented Carbide) | | — | 2800 | 13 | 0.5 |

Sample numbers marked with * are not within the scope of the present invention.

The results shown in Table 6 indicate that samples Nos. III-1 to 3 and 5 to 11 all demonstrated high strength, high hardness and good cutting performance comparable to that of cemented carbide of sample No. 16 in rough cutting operation.

Sample No. III-13 having a Ni+Co content of less than 15% by weight, in contrast, had low flexural strength and was shipped in an early stage of rough cutting. The sample No. III-15 having a Ni+Co content of more than 22% by weight had thicker metal-enriched layer with lower oxidation resistance and lower resistance to plastic deformation, and the cutting edge was worn out.

Sample No. III-12 having a Ti content of less than 55% by weight based on the total content of metals of groups 4a, 5a and 6a of the Periodic Table experienced premature chipping of the tool edge, and sample No. III-12 having a Ti content of more than 80% by weight based on the total content of metals of groups 4a, 5a and 6a of the Periodic Table become enable to cut in an early stage due to wear. Samples No. III-4 and 14 in which the mean grain size of composite metal carbonitride exceeded 1 μm were chipped in an early stage of rough cutting.

EXAMPLE IV

TiCN powder having a mean particle size shown in Table 7, TiN powder, TaC powder, NbC powder, WC powder, ZrC powder and VC powder, all of which having a mean particle size from 0.5 to 2 μm, and Co powder, Ni powder or Co/Ni alloy powder having a mean particle size of 2 μm were mixed in proportion shown in Table 7 in a ball mill in a wet process. The mean particle sizes described above were measured by micro track method.

The mixed powder was molded in the shapes of the throw-away tip and the flexural strength test piece by pressing at a pressure of 98 MPa. The green compacts thus molded were fired in such a process as increasing the temperature to 950° C. at a rate of 12° C./min. in vacuum of 0.01 Torr or less, then increasing the temperature from 950° C. to 1300° C. at a rate of 2° C./min. then increasing the temperature to the firing temperature shown in Table 1 at a rate from 5° C./min. and, after keeping this temperature for one hour, decreasing the temperature to the room temperature at a rate of 12° C./min. in vacuum, thereby to make test pieces of cermet having the shape of TNGA160408 R-S. Samples Nos. IV-8, 9 were fired in the procedure described above except for carrying out the process of raising the temperature to 1300° C. in nitrogen atmosphere at a pressure of 0.2 KPa.

The test pieces were subjected to the measurement of toughness (IF method) in accordance to the JIS R1607. The results are shown in Table 8.

Cross section of the throw-away tip thus obtained at the center thereof with an electron microscope, so as to measure the crystal grain size of the carbonitride phase at two points by intercept method in an observing region of 7×7 μm and determine the mean crystal grain size.

Change in the distribution of metal tungsten concentration near the surface of the throw-away tip was measured by EPMA method. Change in the concentration of metal tungsten from a position in the sintered material (1000 μm deep from the surface) toward the surface was observed and depth of the surface layer where the concentration of metal tungsten was 1.1 times that of the inside or higher was measured. Measurements were made on three test pieces made to the same specification, and the measured values were averaged.

Cutting test under the finish cutting conditions described below was conducted on ten throw-away tips, while measuring the width of wear and surface roughness of the workpiece.

Cutting conditions

Workpiece: Pb-free free cutting steel, round rod

Cutting speed: 210 m/min.

Feed rate: 0.13 mm/rev.

Infeed: 0.5 mm

Cutting time: 20 min.

TABLE 7

| Sample No. | TiCN Mean Grain Size (μm) | Carbonitride Phase Forming Component (wt %) | | | | | | | | Binder Phase Forming Component (wt %) | | | Total (wt %) | Firing Conditions Atmosphere in Process of Raising Temperature | Firing Temperature (° C.) | Atmosphere in Process of Decreasing Temperature |
|---|---|---|---|---|---|---|---|---|---|---|---|---|---|---|---|---|
| | | TiCN | TiN | TaC | NbC | WC | ZrC | VC | Ti/total | Ni | Co | Ni + Co | | | | |
| IV-1 | 0.5 | 45 | 13 | 2 | 12 | 19 | 3 | 2 | 96.0 | 2 | 2 | 4 | 100.0 | Vacuum | 1500 | Vacuum |
| IV-2 | 0.7 | 45 | 13 | 0 | 15 | 18 | 3 | 1 | 95.0 | 1 | 4 | 5 | 100.0 | Vacuum | 1600 | Vacuum |
| IV-3 | 0.9 | 45 | 13 | 0 | 10 | 19 | 3 | | 91.0 | 3 | 6 | 9 | 100.0 | Vacuum | 1550 | Vacuum |
| IV-4 | 0.9 | 45 | 13 | 5 | 10 | 15 | 3 | 3 | 92.0 | 3 | 5 | 8 | 100.0 | Vacuum | 1575 | Vacuum |
| IV-5 | 0.7 | 52 | 13 | 2 | 6 | 14 | 1 | 2 | 90.0 | 3 | 7 | 10 | 100.0 | Vacuum | 1575 | Vacuum |
| IV-6 | 0.7 | 52 | 12 | 1 | 3 | 18 | 1 | 3 | 90.0 | 4 | 6 | 10 | 100.0 | Vacuum | 1550 | Vacuum |
| IV-7 | 0.7 | 50 | 13 | 3 | 5 | 13 | 1 | 2 | 87.0 | 4 | 9 | 13 | 100.0 | Vacuum | 1575 | Vacuum |
| *IV-8 | 0.7 | 48 | 12 | 1 | 13 | 20 | 2 | 1 | 97.0 | 1 | 2 | 3 | 100.0 | Vacuum | 1575 | Vacuum |
| *IV-9 | 0.9 | 40 | 25 | 5 | 0 | 10 | 2 | 2 | 84.0 | 4 | 12 | 16 | 100.0 | Vacuum | 1550 | Vacuum |
| *IV-10 | 1.5 | 41 | 16 | 10 | 5 | 15 | 3 | 0 | 90.0 | 4 | 6 | 10 | 100.0 | Nitrogen | 1550 | Nitrogen |
| *IV-11 | 0.7 | 62 | 19 | 0 | 2 | 5 | 3 | 5 | 96.0 | 1 | 3 | 4 | 100.0 | Nitrogen | 1500 | Nitrogen |

Sample numbers marked with * are not within the scope of the present invention.

TABLE 8

| Sample No. | Mean Grain Size of Carbonitride Phase (μm) | Thickness of Surface Layer (μm) | Carbonitride Coating Layer | Width of Wear (mm) | Surface Roughness (μm) |
|---|---|---|---|---|---|
| IV-1 | 0.6 | 30 | — | 0.12 | 2.42 |
| IV-2 | 0.8 | 33 | | 0.11 | 2.14 |
| IV-3 | 0.9 | 32 | — | 0.10 | 1.94 |
| IV-4 | 1.2 | 38 | — | 0.09 | 1.72 |
| IV-5 | 0.8 | 48 | — | 0.09 | 1.84 |
| IV-6 | 0.9 | 39 | $(Ti_{0.5}Al_{0.5})N$ | 0.07 | 1.63 |
| IV-7 | 0.7 | 57 | $(Ti_{0.5}Al_{0.5})N$ TiN | 0.08 | 1.93 |
| *IV-8 | 0.8 | — | — | Chipping | — |
| *IV-9 | 0.9 | — | — | 0.25 | 6.51 |
| *IV-10 | 2.2 | 20 | — | 0.21 | 5.37 |
| *IV-11 | 0.8 | 70 | — | Chipping | |

Sample numbers marked with * are not within the scope of the present invention.

The results shown in Table 8 indicate that samples Nos. IV-1 to 7 all demonstrated high hardness with very small and stable surface roughness of the workpiece after machining.

Sample No. IV-8 having a NI+Co content of more than 4% by weight, in contrast, had low flexural strength and was chipped in an early stage of finishing operation. The No. IV-9 having a Ni+Co content of more than 14% by weight had thicker surface layer with lower oxidation resistance and lower resistance to plastic deformation, and the cutting edge was worn out.

Sample No. IV-10 having a Ti content of less than 55% by weight based on the total content of metals of groups 4a, 5a and 6a of the Periodic Table experienced premature chipping of the tool edge, and sample No. IV-11 having a Ti content of more than 80% by weight based on the total content of metals of groups 4a, 5a and 6a of the Periodic Table became unable to cut in an early stage of cutting operation due to wear.

Although the present invention has been described in relation to particular embodiments thereof, many other variation and other uses will become apparent to those skilled in the art. Therefore, the present invention is to be limited not by the specific disclosure herein but only by the appended claims.

What is claimed is:

1. A throw-away tip satisfying the following constituent features (a) to (d) used for machining a workpiece with a cutting edge applied thereto:

(a) the throw-away tip comprises 1 to 30% by weight of a binder phase comprising at least one kind of Co and Ni, and 70 to 99% by weight of a carbonitride phase comprising carbonitride of Ti and one or more kind other than Ti among metals of groups 4a, 5a and 6a of the Periodic Table;

(b) a mean grain size of the carbonitride phase is 1.5 μm or less;

(c) the shape is substantially flat plate; and (d) flexural strength including the side faces of the throw-away tips show a Weibull coefficient of 9.8 or higher for the flexural strength.

2. The throw-away tip according to claim 1, wherein the maximum size of crystal grain that becomes a fracture origin, observed in the fracture surface of the throw-away tip after a flexural strength test, is 10 μm or smaller.

3. The throw-away tip according to claim 1, wherein 50% or more of the fracture origins, observed in the fracture surface after the flexural strength test, comprise voids of which a part or all of the wall surface is covered by a skin comprising the binder phase.

4. The throw-away tip according to claim 3, wherein the maximum size of the voids of the fracture origin is 200 μm or smaller.

5. The throw-away tip according to claim 3, wherein the voids of which a part or all of the wall surface is covered by the skin comprising the binder phase have wave pattern on the surface of the skin.

6. The throw-away tip according to claim 3, wherein the binder phase contains the highest concentration of Co.

7. The throw-away tip according to claim 1, wherein the mean grain size of the carbonitride phase in the throw-away tip is in a range from 0.3 to 1 μm.

8. A throw-away tip that satisfies the following constituent features:

(a) the throw-away tip comprises 1 to 30% by weight of a binder phase comprising at least one kind of Co and Ni, and 70 to 99% by weight of a carbonitride phase comprising carbonitride of Ti and one or more kind other than Ti among metals of groups 4a, 5a and 6a of the Periodic Table;

(b) a mean grain size of the carbonitride phase is 1.5 μm or less; and (c) 50% or more of the fracture origins, observed in the fracture surface flexural strength test, comprise voids of which a part or all of the wall surface is covered by a skin comprising the binder phase.

9. The throw-away tip according to claim 8, wherein the maximum size of the voids of the fracture origin is 200 μm or smaller.

* * * * *